United States Patent [19]

Pai

[11] Patent Number: 5,029,744

[45] Date of Patent: Jul. 9, 1991

[54] MECHANISM FOR CONTROLLING THE POWDER IMPACT FORCE ON A PROJECTILE

[75] Inventor: Antony Pai, Taipei, Taiwan

[73] Assignee: Hsin-Ho Mfg. Co. Ltd., Taipei, Taiwan

[21] Appl. No.: 537,136

[22] Filed: Jun. 13, 1990

[51] Int. Cl.[5] ..... B25C 1/14

[52] U.S. Cl. ..... 227/9; 227/10

[58] Field of Search ..... 227/10, 9, 11

[56] References Cited

U.S. PATENT DOCUMENTS

| | | | |
|---|---|---|---|
| 3,659,768 | 5/1972 | Brunelle | 227/10 |
| 4,382,533 | 5/1983 | Buechel et al. | 227/10 |
| 4,883,211 | 11/1989 | Philipp et al. | 227/9 |
| 4,883,212 | 11/1989 | Philipp | 227/9 |

*Primary Examiner*—Frank T. Yost
*Assistant Examiner*—John M. Husar
*Attorney, Agent, or Firm*—Notaro & Michalos

[57] ABSTRACT

A mechanism for controlling the powder impact force on a projectile in an impact dissipating device includes a stop member having a projecting stop portion which can be engaged with a stop ring of a piston. A base portion of the projecting stop portion includes a substantially ellipsoid guided face having linear stop edes formed on both longer sides of the guided face. The mechanism also has a stop rod with a step-shaped portion on top which can be engaged with the stop edge. A threaded hole is provided on the lower portion of the stop rod. A control rod has a front end provided with a rotation portion and, adjacent the rear of the rotation portion, a securing ring is formed at the periphery of the control rod. A threaded portion is provided at the rear end of the rod and is threaded into the threaded hole of the stop rod. A substantially L-shaped securing piece has an upstanding portion with a notch formed in the upstanding portion and engaged with the control rod between the rotation portion and the securing ring. A securing hole formed at another end of the securing piece secures the securing piece in the lower portion of a grip body of the impact dissipating device.

3 Claims, 3 Drawing Sheets

MECHANISM FOR CONTROLLING THE POWDER IMPACT FORCE ON A PROJECTILE

BACKGROUND OF THE INVENTION

This invention is related to a mechanism for controlling the powder impact force on a projectile; the object is mainly to control the volume of the powder explosion space so a to control the impact force.

This invention can be applied to a impact dissipating device havig a main structure which mainly includes a tool body (1), a barrel (11), a handle (2), a piston (12) in said barrel, a pile sleeve (13) provided at the front end of said barrel, a breech plug (16) provided at the rear end of said barrel, a seat for firing pin (17), a safety member (171), a firing pin (174), a trigger (18), springs (153, 175, 182), a steel ball (181) and a balance washer (21) etc., wherein said safety member (171) is designed for safety; i.e., when in use, the opening of the tool body must be urged against the working surface and press the working surface, then the strike can be allowed. Further, a muffling chamber (14) is provided under the barrel in the interior of the tool body so as to make the sound wave convect and eliminate the explosive sound. A reset pin (15) is mounted under the barrel to make the piston (12) return to its original position after striking. The main structure mentioned above thus constitutes a novel design for ensuring safety, being convenient in use, making no explosive sound, and completing the striking of the projectile under the circumstances that the working place lacks other power sources.

However, the aforesaid impact dissipating device, after being used, is considered to have the defect that the powder impact force can not be adjusted to apply to the different working condition.

SUMMARY OF THE INVENTION

Hence, it is expected to add a mechanism for controlling the powder impact force on said existing structure. After a long-time study, the applicant has invented a control mechanism for powder impact force which can be applied to the aforesaid impact dissipating device. By using said control mechanism, the powder impact force can be controlled when striking.

BRIEF DESCRIPTION OF THE INVENTION

A complete understanding of the invention may be obtained from the following detailed description of a control mechanism for controlling the powder impact force forming a specific embodiment thereof, when read in conjunction with the appended drawings, in which.

DETAILED DESCRIPTION OF THE INVENTION

Figure 1:
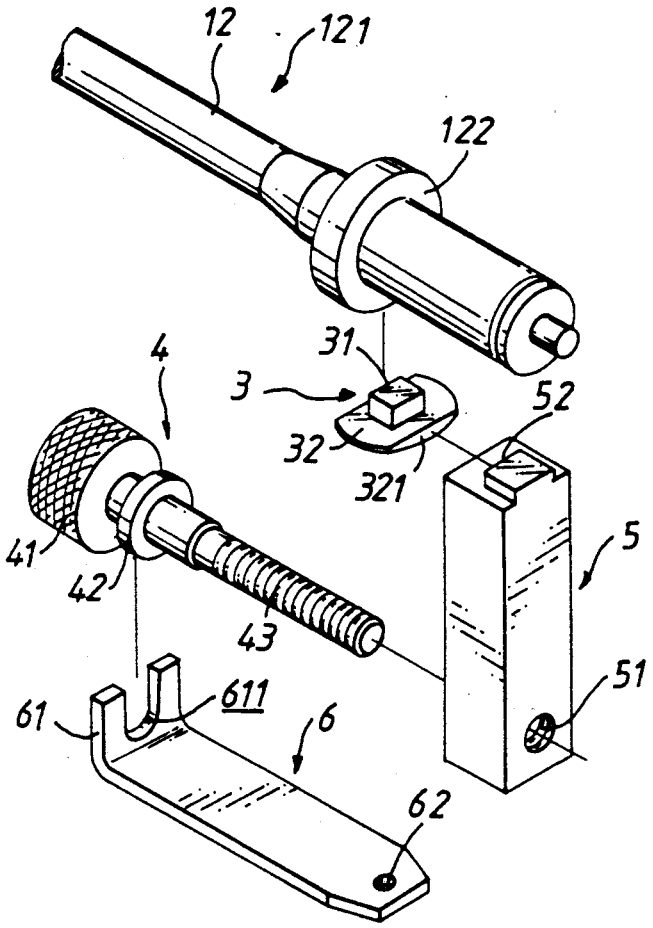
FIG. 1 is three-dimensional view of a control mechanism for powder impact force forming one embodiment of the invention.

Referring now in detail to the mechanism for controlling the powder impact force on a projectile of FIG. 1, a stop ring (122) is formed behind the stop neck portion (121) of a piston (12), said stop ring (122) can be engaged with a stop member (3) which will be described hereinafter. Under the barrel (11) of this application, there is a longer elongate groove (112), and a guiding groove (113) is formed adjacent to the rear portion of elongate groove (112), which is provided to let the stop member (3) slide therein. Said stop member (3) mainly has a projecting stop portion (31) which can be engaged with said stop ring (122), and the base portion of said projecting stop portion (31) is integrally formed on a substantially ellipsoid guided face (32), with linear stop edges (321) formed on both longer sides of said guided face (32). The stop edges (321) can be engaged with a stop rod (5) Which will be described hereinafter. The number 4 of the drawing is related to a threaded control rod, said control rod (4) mainly including: a rotation portion (41) at one (front) end; a securing ring (42) formed at the periphery of said control rod adjacent to the rear side of said rotation portion; and a threaded portion (43) formed about the periphery of said rod at its opposite (rear end). The stop rod (5) is a substantially oblong column-shaped rod, a threaded hole (51) being provided on the lower portion of said stop rod which can be connected with the threaded portion (43) of said control rod (4) in a screw joint relationship, and a step-shaped portion (52) being provided on the top portion of said stop rod to engage with the stop edge (321) of said stop member (3). Said stop edges (321) are formed in a linear manner to increase the engagement area and the stop effect. The number 6 is related to a securing piece which is substantially L-shaped, at the front end of said piece (6), the upstanding portion (61) being provided with a notch (611); the size of notch (611) is fit in with the periphery of a shaft portion adjacent to the securing ring (42) of said control rod (4), and a securing hole (62) being formed at the rear portion of said securing piece.

Figure 2:
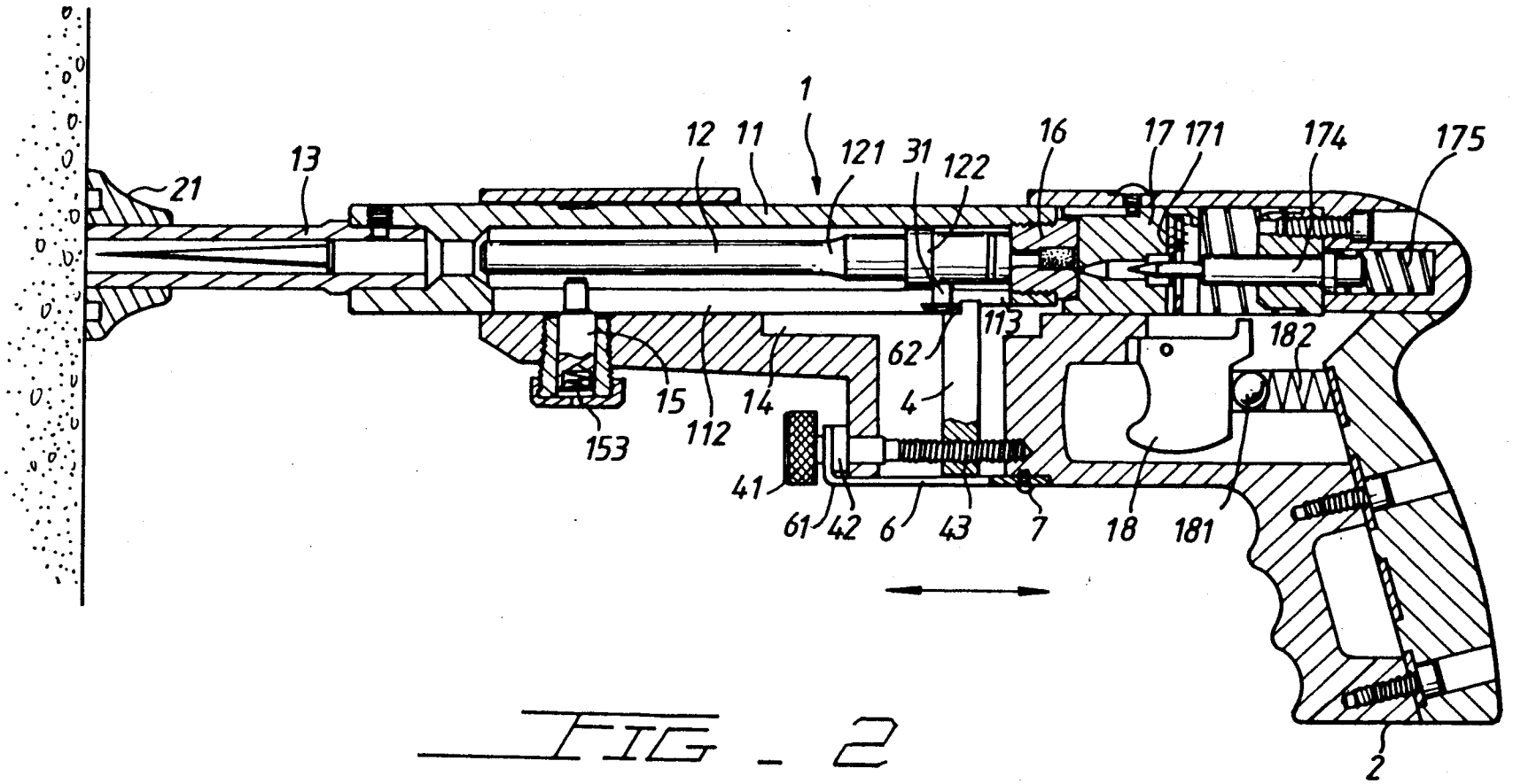
FIG. 2 is a sectional view of the control mechanism for powder impact force, which is in the relative position before the powder impact force has been adjusted.
Figure 3:
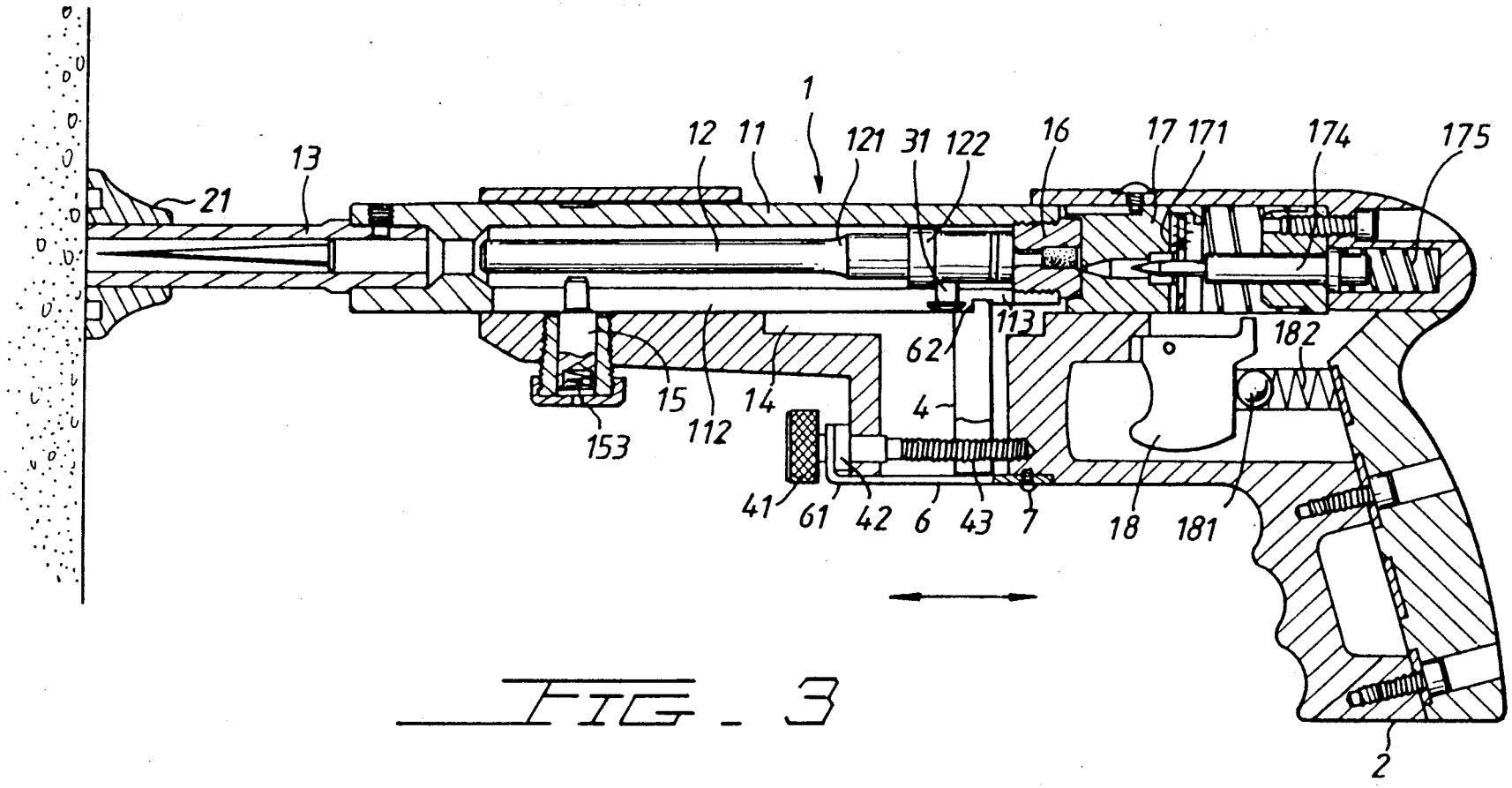
FIG. 3 is a sectional view of the control mechanism for powder impact force, which is in the relative position after the powder impact force has been adjusted.

Please refer now to the FIG. 2 and FIG. 3, which shows the relative position and operation of the invention after being assembled.

As seen from the drawing, the stop member (3) can be slide in the guiding groove (113); said control rod (4) is secured to the securing piece (6) by utilizing the shaft portion between securing ring (42) and rotation portion (41) of said controlled rod (4) to engage with the notch (611) of the upstanding portion (61) of said securing piece and by using a bolt (7), said securing piece (6) can be fastened at the bottom portion of the body (1). Since the securing piece (6) secures the control rod (4) and this the control rod can not move in the direction of the arrow as indicated in the drawings and can only rotate in the clockwise or counterclockwise direction. Further, the threaded hole (51) of said rod (5) is connected with the threaded portion (43) of said control rod (4) in a screw joint relationship; thus, when the control rod is rotated in the counter-clockwise direction, the stop rod (5) will move to the right in the drawing and when the control rod is rotated in the clockwise direction, the stop rod (5) will move to the left.

It is easy to understand by referring to FIG. 2, the powder explosion space will be defined by the stop ring (122) of the piston (12), but the stop ring (122) is limited by the stop member (3) and the stop member (3) is limited by the step-shaped portion (52) of the stop rod (5); hence, we can control the volume of a powder explosion chamber (162) by rotating the rotation portion (41) of the control rod (4); i.e., when powder explosion chamber (162) is smaller, the impact force will be stronger and when powder explosion chamber (162) is larger, the impact force will be smaller.

After the volume of said explosion chamber (162) has been adjusted, then the normal striking proceed. After striking the barrel (11) can be drawn forward until reaching the position where the barrel is stopped by the reset pin (15). Further, by the reversion action of said reset pin (15), the piston (12) can be returned to the original postion (i.e., the position for the maximum powder impact force), then the barrel (11) is drawn back toward the normal positioning point, In the meantime, by the location limit function of said stop rod (5) which position has been adjusted, the piston (12) is stopped at said limited position during the drawing back action and thus is in the condition as shown in FIG. 3. This only explains the condition in adjustment in accordance with this invention, the other adjustments like this can also be performed according to the aforesaid steps, which will not be further described here.

FIG. 3 shows that when rotating the rotation portion (41) of the control rod (4) in the counterclockwise direction, the stop rod (5) will move toward the right and thus the space of the explosion chamber (162) becomes smaller, which will make the powder impact force become stronger during the next strike; on the other hand, when rotating the rotation portion (41) in the clockwise direction, the impact force wil be smaller.

The above-described structure is very safe and also very efficient in its operation. It also is very simple and inexpensive in its manufacture, while being a very rugged, durable tool, as well as highly dependable.

It is to be understand that the above-described arrangements are simply illustrative of the application of the principles of the invention. Numerous other arrangements may be readily devised by those skilled in the art which will embody the principles of the invention and fall within the spirit and scope thereof.

I claim:

1. In an impact dissipating tool having a body (1), a barrel (11), a piston (12) movable in the barrel for ejecting the projectile from the tool, a breech plug (16) closing one end of the barrel and defining a powder explosion chamber with the piston, the breech being adapted for receiving a charge which is ignitable for producing an explosion in the powder explosion chamber, the piston having a stop ring (122), the improvement comprising a mechanism for controlling a powder impact force on a projectile, comprising:

a stop member (3) having a projecting stop portion (31) which is engagable with the stop ring of the piston for holding the piston at a spaced location from the breech plug to define a size of the explosion chamber, the stop member having a base portion integrally formed with the stop portion, the base portion having a substantially ellipsoid guided face (32), and linear stop edges (321) formed on both longer sides of said guided face;

a stop rod (5) having a top provided with a step-shaped portion (52) which is engaged with one of said stop edges, said stop rod having a threaded hole (51) provided on a lower portion of said stop rod;

a control rod (4) having a front end provided with a rotation portion (41) for rotating said control rod and, adjacent a rear end of said rotation portion, a securing ring (42), said control rod having a threaded portion (43) at a rear end of said control rod and threaded into the threaded hole of said stop rod, said rotation portion being rotatable to move said stop rod and the piston toward and away from the breech plug to reduce and enlarge the explosion chamber for controlling a power impact force caused by an explosion in said explosion chamber; and a substantially L-shaped securing piece (6) with a front end formed as an upstanding portion (61), a notch (611) in said upstanding portion for engaging said control rod between said rotation portion and said securing ring, and a securing hole (62) in an opposite rear end of said securing piece for securing said securing piece at a lower portion of the body.

2. The improvement of claim 1, wherein said control rod extends parallel to the barrel and direction of movement of the piston.

3. The improvement of claim 2, wherein the barrel includes a groove (113) extending parallel to the direction of movement of the piston, the stop member (3) being slidably mounted in the groove.

* * * * *